US007721635B2

(12) United States Patent
Luo et al.

(10) Patent No.: US 7,721,635 B2
(45) Date of Patent: May 25, 2010

(54) LEVER HANDLED PAPER PUNCH

(75) Inventors: Xiaoquan Luo, Bronx, NY (US); Peter Chen, West Windsor, NJ (US); Jungkun Lee, Edison, NJ (US)

(73) Assignee: Officemate International Corporation, Edison, NJ (US)

( * ) Notice: Subject to any disclaimer, the term of this patent is extended or adjusted under 35 U.S.C. 154(b) by 136 days.

(21) Appl. No.: 11/653,693

(22) Filed: Jan. 16, 2007

(65) Prior Publication Data

US 2008/0168874 A1 Jul. 17, 2008

(51) Int. Cl.
*B26F 1/04* (2006.01)
*B26F 1/32* (2006.01)
*B26D 5/08* (2006.01)

(52) U.S. Cl. ..... 83/628; 83/549; 83/618; 83/633; 83/588

(58) Field of Classification Search ..... 83/549, 83/588, 627, 618, 691, 167, 620, 687, 633, 83/628, 684, 630, 699, 669
See application file for complete search history.

(56) References Cited

U.S. PATENT DOCUMENTS 2,244,320 A * 6/1941 Unger ..... 83/468
3,469,486 A * 9/1969 Neilsen ..... 83/522.22
4,166,404 A * 9/1979 Almog ..... 83/167
4,294,152 A * 10/1981 Land ..... 83/588
4,688,457 A * 8/1987 Neilsen et al. ..... 83/468
5,163,350 A * 11/1992 Groswith et al. ..... 83/549
5,664,473 A * 9/1997 Huang ..... 83/620
5,740,712 A * 4/1998 Watkins et al. ..... 83/549
5,778,750 A * 7/1998 Drzewiecki et al. ..... 83/628
5,787,783 A * 8/1998 Evans et al. ..... 83/618
6,032,566 A * 3/2000 Evans et al. ..... 83/618
6,109,155 A * 8/2000 Huang ..... 83/628
D564,593 S * 3/2008 Kent et al. ..... D19/72
2002/0020272 A1* 2/2002 Godston et al. ..... 83/620
2007/0227286 A1* 10/2007 Kandasamy ..... 74/469
2007/0266836 A1* 11/2007 Marks ..... 83/684

* cited by examiner

*Primary Examiner*—Boyer D. Ashley
*Assistant Examiner*—Laura M. Lee
(74) *Attorney, Agent, or Firm*—Lerner, David, Littenberg, Krumholz & Mentlik, LLP

(57) ABSTRACT

A punch apparatus for punching holes through a paper stack. The apparatus has a rotationally attached lever handle. The lever handle has a handle end, a contact end, and a rotation axis between the handle end and the contact end. When a downward force is applied to the handle end, the lever handle rotates about the rotation axis. The contact end of the lever handle then exerts a force on a lever arm which in turn rotates a main shaft and attached pressure plate. As a result, the pressure plate exerts a punching force down on punch pins causing them to punch down through the paper stack.

14 Claims, 7 Drawing Sheets

LEVER HANDLED PAPER PUNCH

FIELD OF THE INVENTION

The present invention relates to a punch apparatus having a lever handle for punching holes in a stack of paper sheets.

BACKGROUND OF THE INVENTION

Prior art paper punches typically use a direct force approach to punch holes in a stack of paper sheets. In these prior punches, the user presses down on a pivoting cover flap which forces the punch pins down and into the paper stack. This direct force approach has very little mechanical advantage. The force required to punch through the holes increases with the thickness of the paper stack. For thicker paper stacks, the required force to punch through the stack may exceed what the user can easily provide.

To address this problem, several punch manufacturers have proposed using a lever mechanism to reduce the required force by increasing the mechanical advantage. For example, U.S. Pat. No. 5,778,750 proposes the use of an elongated lever handle where one end of the handle is pivotally fixed to the punch and the other end is pressed down by the user. In turn, an intermediate surface (between the ends of the handle) is forced down on the cover flap to exert the punching force. In U.S. Pat. No. 6,109,155, a lever handle is pivotally attached to a rod extending up from the based and through the cover flap. As in the '750 patent, when the handle is pressed down by the user, an intermediate surface on the lever presses down on the cover flap to exert the punching force. Both of these patents disclose the use of a lever handle to increase the force applied to the cover flap by mechanical advantage. This effectively reduces the maximum force the user needs to apply to punch the paper stack.

The present invention offers a novel lever-handled paper punch which increases the mechanical advantage in a different manner than other proposed lever punches. The present punch reduces the maximum punch force and improves upon the disadvantages of prior art punches.

SUMMARY OF THE INVENTION

The present invention is directed to a punch apparatus for punching holes through a paper stack. The apparatus has a punch base with an attached mounting plate. Punch pins are mounted to the mounting plate for punching through the paper stack. A lever handle is rotationally attached to the mounting plate. The lever handle has a handle end, a contact end, and a rotation axis between the handle end and the contact end. A main shaft is rotationally mounted on the punch base. A lever arm and pressure plate are attached to the main shaft. The lever arm engages the contact end of the lever handle while the pressure plate engages the punch pins. When a downward force is applied to the handle end of the lever handle, the lever handle rotates about the rotation axis. The contact end of the lever handle then exerts an upward force on the lever arm which in turn rotates the main shaft and attached pressure plate. As a result, the pressure plate exerts a punching force down on the punch pins thereby causing the punch pins to punch down through the paper stack.

Other aspects of the invention include that the punching force is greater than the downward force due to a mechanical advantage of the lever handle. Each punch pin may be aligned in a punch head bracket adjustably mounted to the mounting plate. Each punch head bracket preferably has a paper feed slot for positioning the paper stack. Each punch pin has a top end engaged by the pressure plate and a punch end for punching through the paper stack positioned in the paper feed slot. The punch pins are preferably spring mounted in the punch head brackets such that the punch ends are retracted above the paper feed slot when the downward force is not being applied. A cover may be mounted on the punch base for covering the mounting plate, the main shaft, the lever arm, the pressure plate, and the plural punch head brackets. Preferably, the cover does not move during operation of the punch apparatus. The contact end of the lever handle is preferably a cylindrically-shaped transverse pin. The lever arm may have a cylindrically-shaped contact pin for engaging the contact end of the lever handle. The handle end may have a padded region. The punch base may have a chip tray for collecting paper hole cutouts punched from the paper stack. The punch base may have a window for viewing inside the chip tray. Assuming the main shaft rotates about a first axis, the punch pins move in the direction of a second axis, and the lever handle rotates about a third axis; it is preferred that the first, second and third axes be orthogonal.

Another embodiment of the invention is directed to a paper punch comprising a base having a substantially rectangular shape. A mounting plate is fixedly attached on the base. A main shaft is rotationally attached along a longitudinal axis of the base. The main shaft has a longitudinally attached pressure plate and a perpendicularly extending lever arm. A lever handle is rotationally attached to the mounting plate. The lever handle comprises a handle portion, a contact portion, and a rotation axis between the handle and contact portions. The rotation axis is perpendicular to the longitudinal axis. The contact portion of the lever handle is in contact with the lever arm of the main shaft. A plurality of punch units are attached to the mounting plate and are in contact with the pressure plate. When an applied force is exerted on the handle portion of the lever handle, it is transferred through the rotation axis to the contact portion which forces the lever arm to rotate the main shaft such that the pressure plate transfers a punching force to the plurality of punch units to punch holes in a stack of paper sheets.

BRIEF DESCRIPTION OF THE DRAWINGS

These and other features, aspects, and advantages of the present invention will become better understood with regard to the following description, appended claims and accompanying drawings where:

DESCRIPTION OF THE PREFERRED EMBODIMENTS

The present invention uses a lever handle on a paper punch in a novel manner for increased mechanical advantage. The lever handle effectively reduces the amount of force required from the user to punch holes in a stack of paper sheets.

Figure 1:
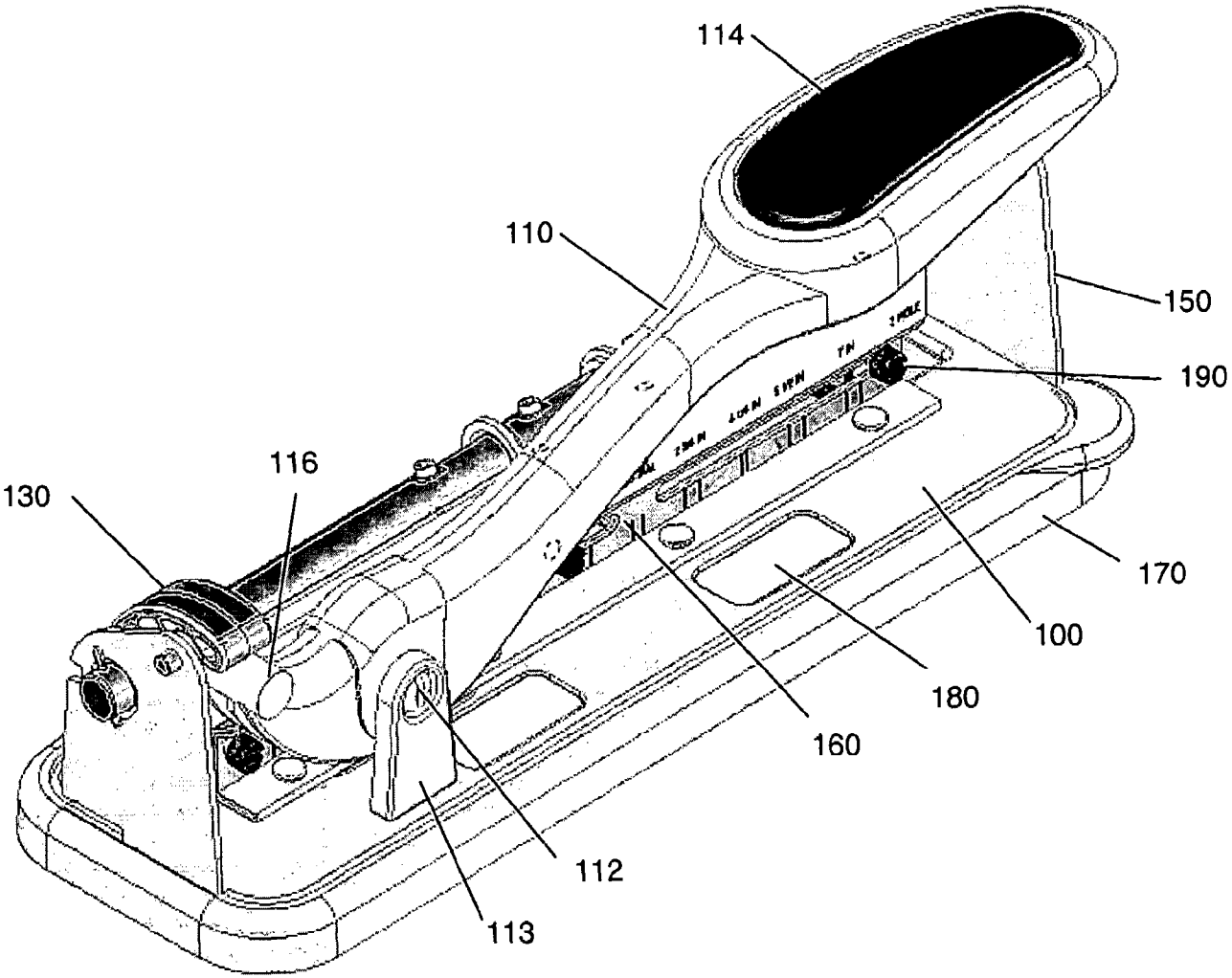
FIG. 1 is a back perspective view of an embodiment of the lever-handled punch.

FIG. 1 is a back perspective view of an embodiment of the lever-handled punch. The punch comprises a base 100 with a mounting plate 160 and left and right side vertical support plates 150. The plates may be attached to the base with rivets or any other suitable attachment means. A lever handle 110 is mounted at an axis point 112 to the mounting plate 160 by a pivot screw. A removable side support 113 may be attached to relieve stress on the pivot screw. Note, the lever handle 110 does not contact the base 100. The lever handle 110 has a handle end 114 which is pressed down upon by the user and a contact end 116 which transfers a force to the punch. The handle end 114 may have a soft padding material. The contact end 116 of the handle is preferably a cylindrically-shaped transverse pin. The upper surface of the contact end 116 contacts the under surface of contact lever arm 130. The mounting plate 160 has a number of slotted holes for mounting and adjusting the spacing of the punch pins using set screws 190. The punch base 100 has a chip tray 170 (bottom cover) for collecting the paper hole cutouts (chips). The chip tray 170 is preferably made of a non-marking, non-skid, semi-pliable material. The punch base may have windows 180 (portals) for viewing inside the chip tray to determine when the punched paper holes need to be emptied.

Figure 2:
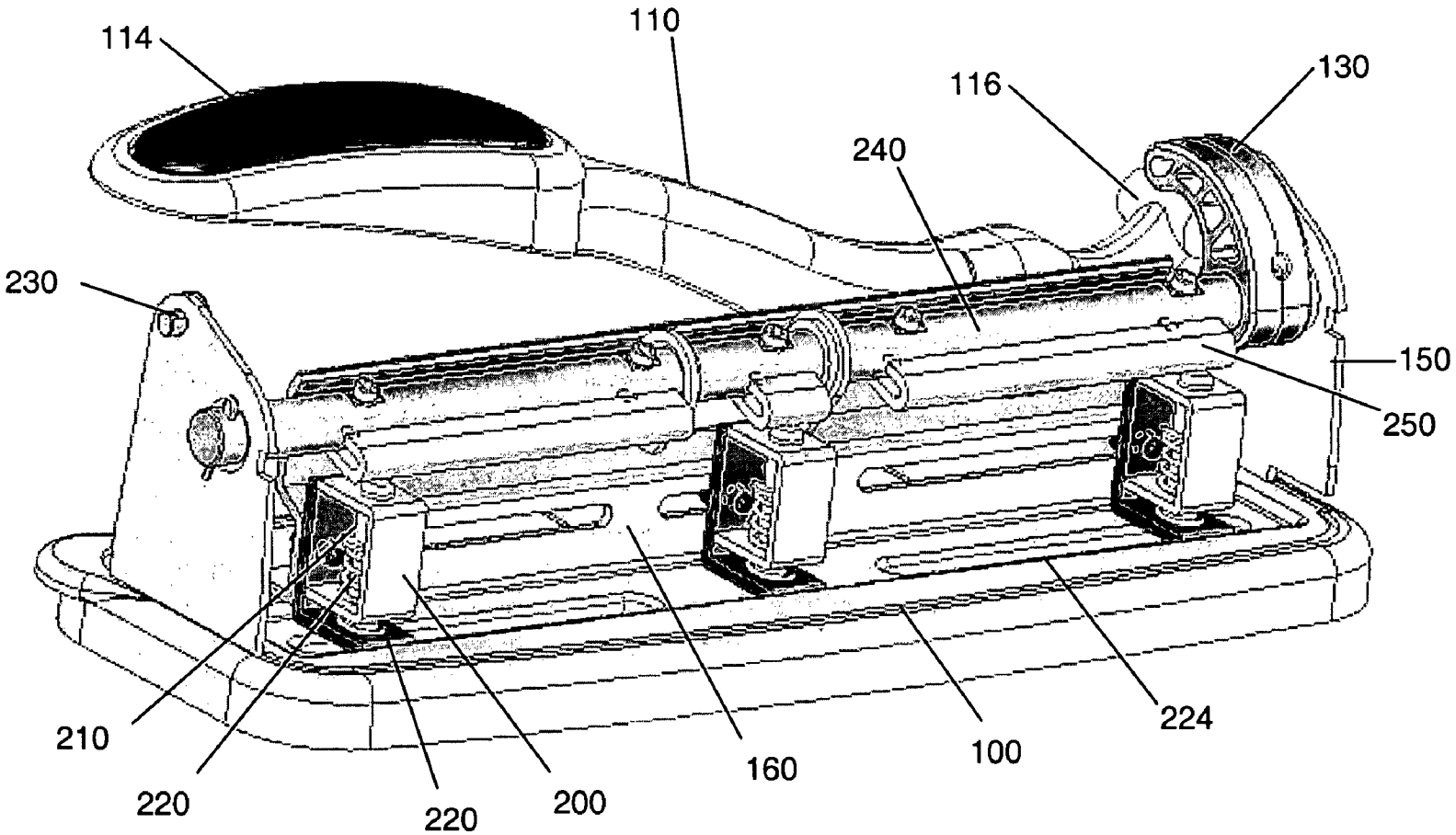
FIG. 2 is a front perspective view of an embodiment of the lever-handled punch.

FIG. 2 is a front perspective view of an embodiment of the lever-handled punch. FIG. 2 shows that contact lever arm 130 is attached at an end of main shaft 240. Pressure plates 250 are mounted to the main shaft, with rivets or any other suitable attachment means. The main shaft is mounted at each end through the left and right side vertical support plates 150 to allow for rotation about its longitudinal axis. A number of punch head brackets 200 are adjustably mounted to the mounting plate 160. Each punch head bracket has a paper feed slot 222 where the paper stack is inserted for punching. Each punch head bracket contains a vertically aligned punch pin 210 which is bias mounted using a spring 220 such that the punch end of the punch pin is retracted above the paper feed slot when no punching force is being applied to the pin. A removable cover 320 (not shown) is attached using cover mounting lock pins 230 on the left and right side vertical support plates.

The present punch is operated by inserting a stack of paper sheets into the paper feed slots 222. The user presses down upon the handle end 114 of the lever handle. By virtue of pivot screw 112, the downward force on the handle end 114 is translated into a leveraged upward force on the contact end 116. The amount of leverage is related to the ratio of the distances between the handle end and the pivot screw and the pivot screw and the contact end. The contact end forces the contact lever arm 130 upward. This upward force is translated through contact lever arm 130 into a rotational force on the main shaft 240. The rotation of the main shaft about its longitudinal axis forces the pressure plates 250 down onto the top ends of the punch pins 210. The punch ends of the pins are driven downward through the paper feed slot to punch through any inserted paper sheets. The paper hole cutouts created by the punching operation drop through slot openings 224 in the base and into the chip tray. When the user stops pressing on the handle, the spring biased punch pins retract up into the punch brackets to clear the paper feed slot so that the punched paper stack can be removed.

Figure 3:
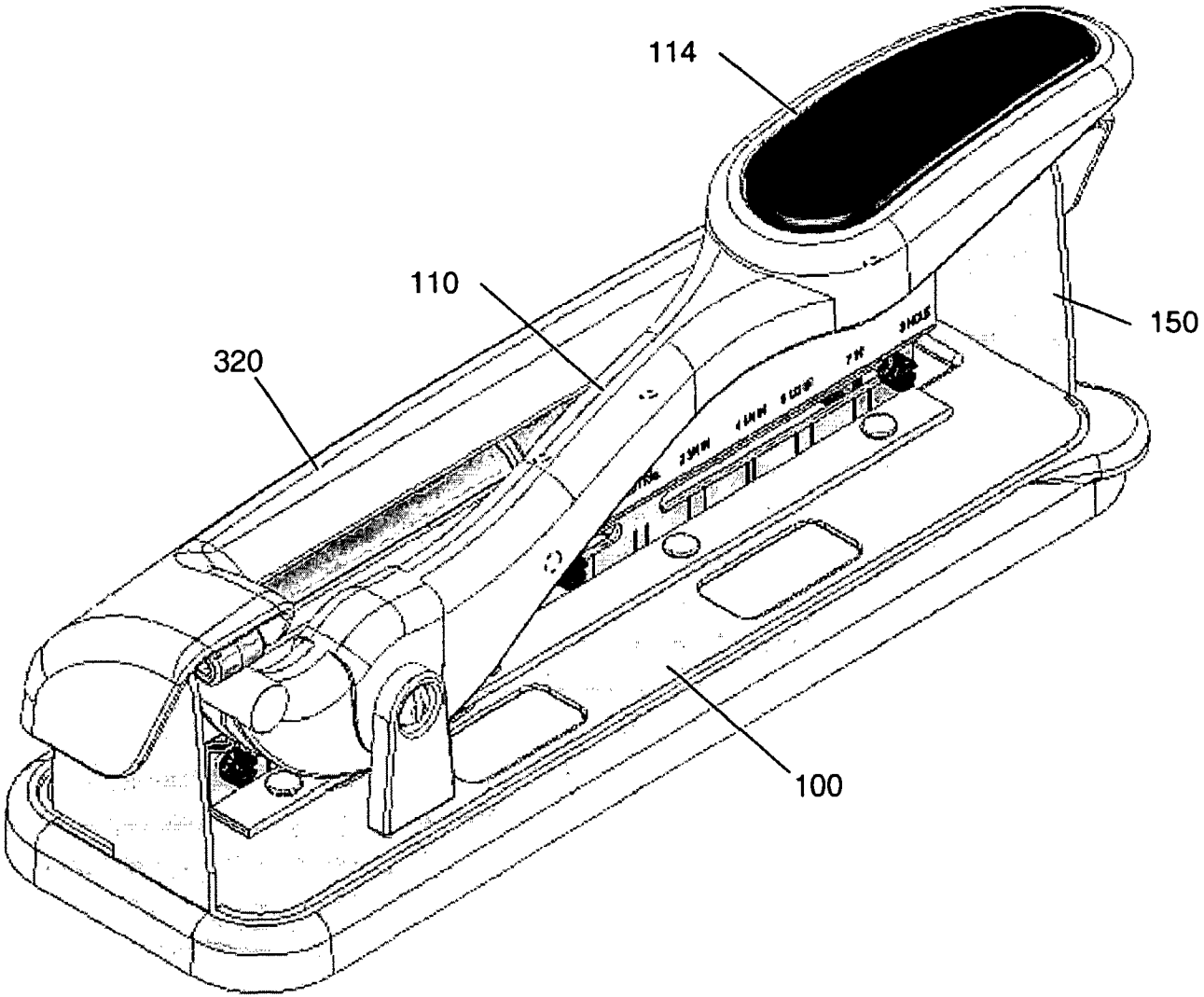
FIG. 3 is a back perspective view of an embodiment of the lever-handled punch with the cover attached.

FIG. 3 is a front perspective view of an embodiment of the lever-handled punch with the removable cover 320 attached. The cover preferably attaches to the left and right side vertical support plates 150. The cover does not contact the lever arm and does not move during operation of the punch.

Figure 4:
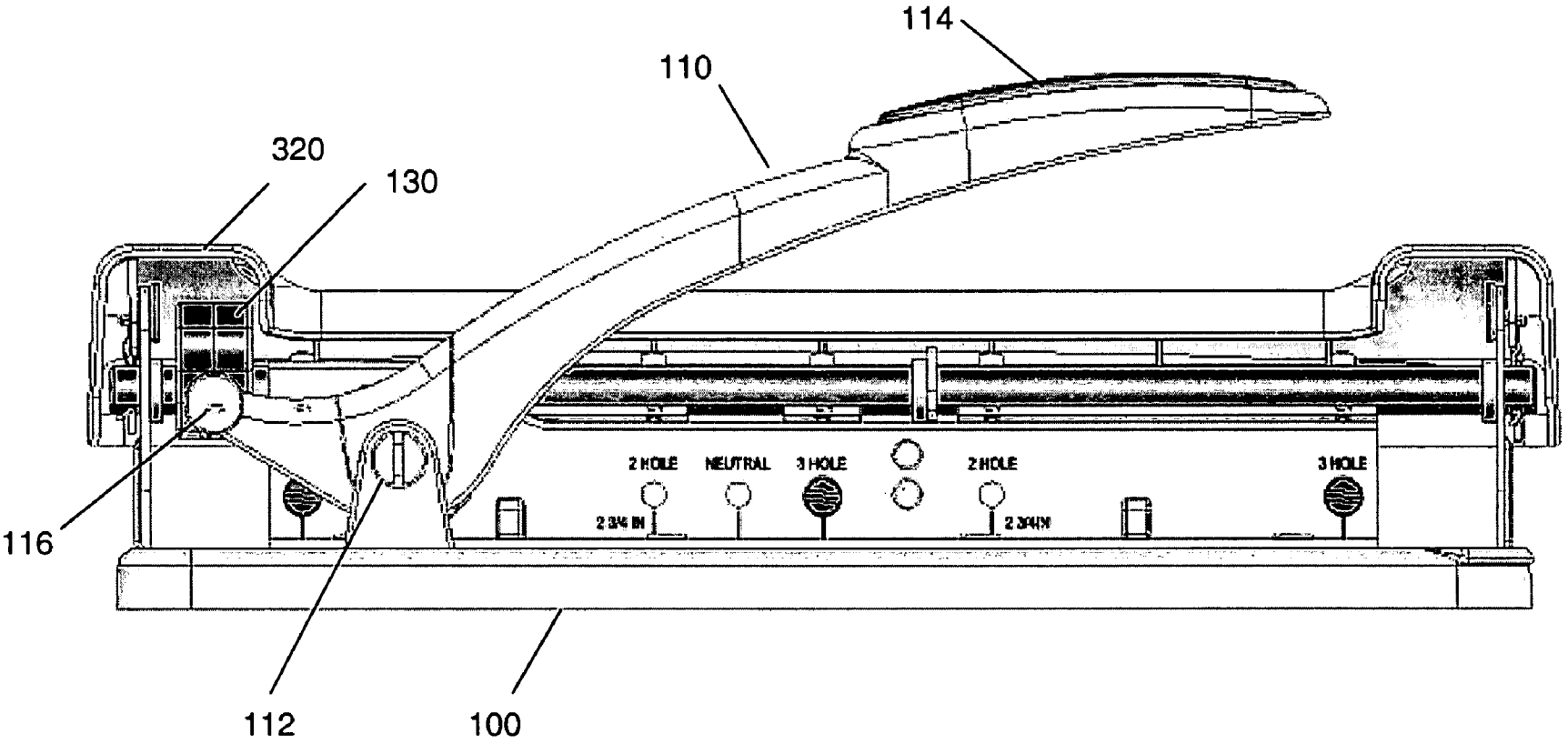
FIG. 4 is a back view of an embodiment of the lever-handled punch.
Figure 5:
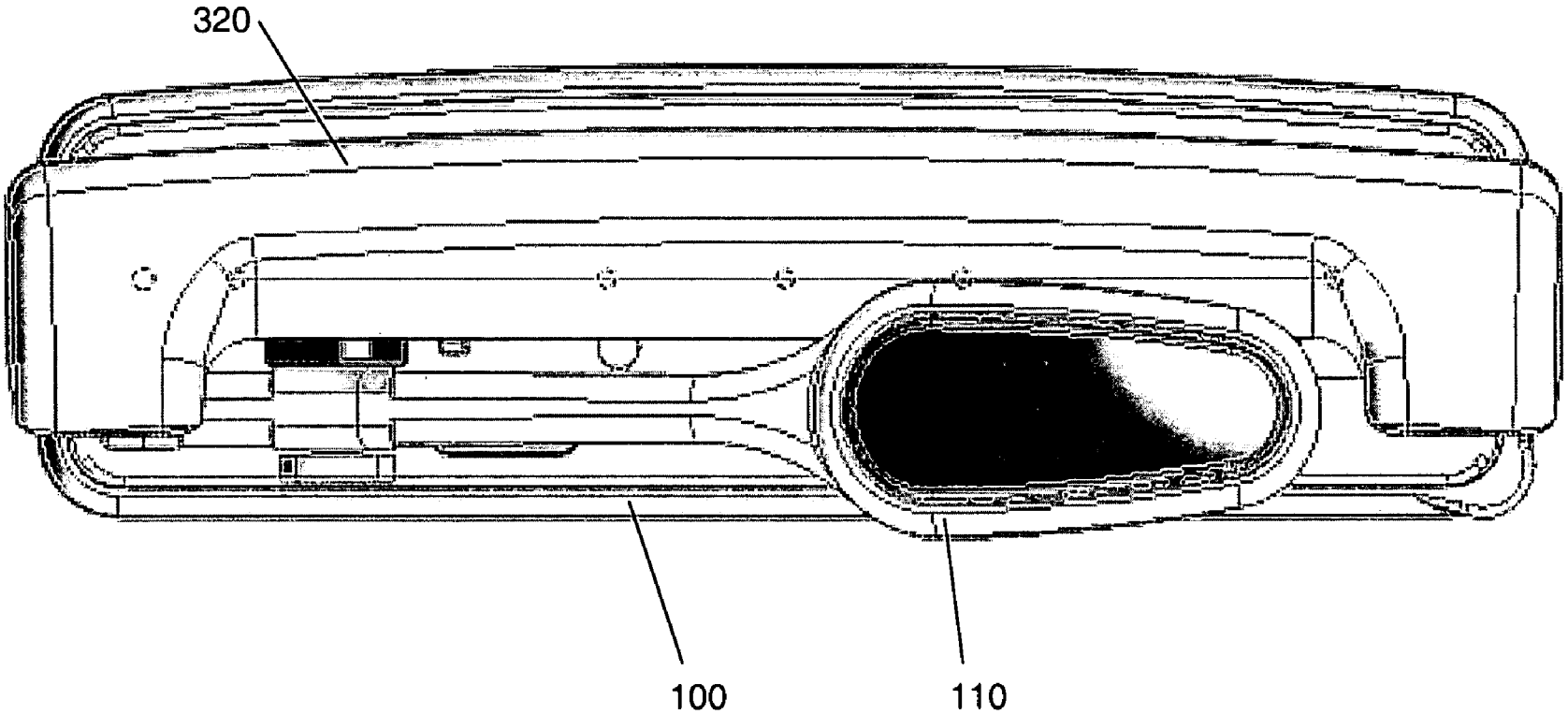
FIG. 5 is a top view of an embodiment of the lever-handled punch with the cover attached.
Figure 6:
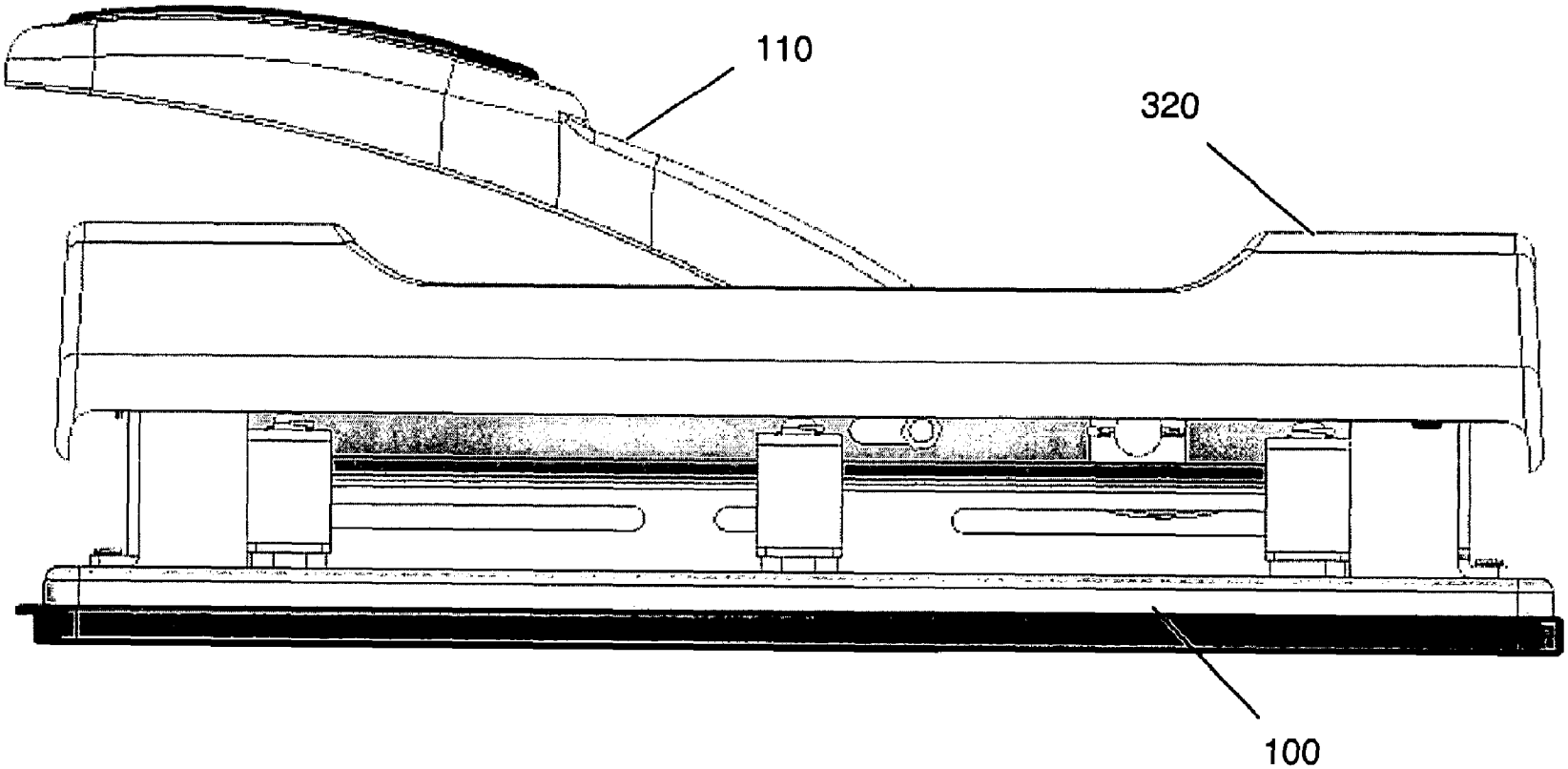
FIG. 6 is a front view of an embodiment of the lever-handled punch with the cover attached.
Figure 7:
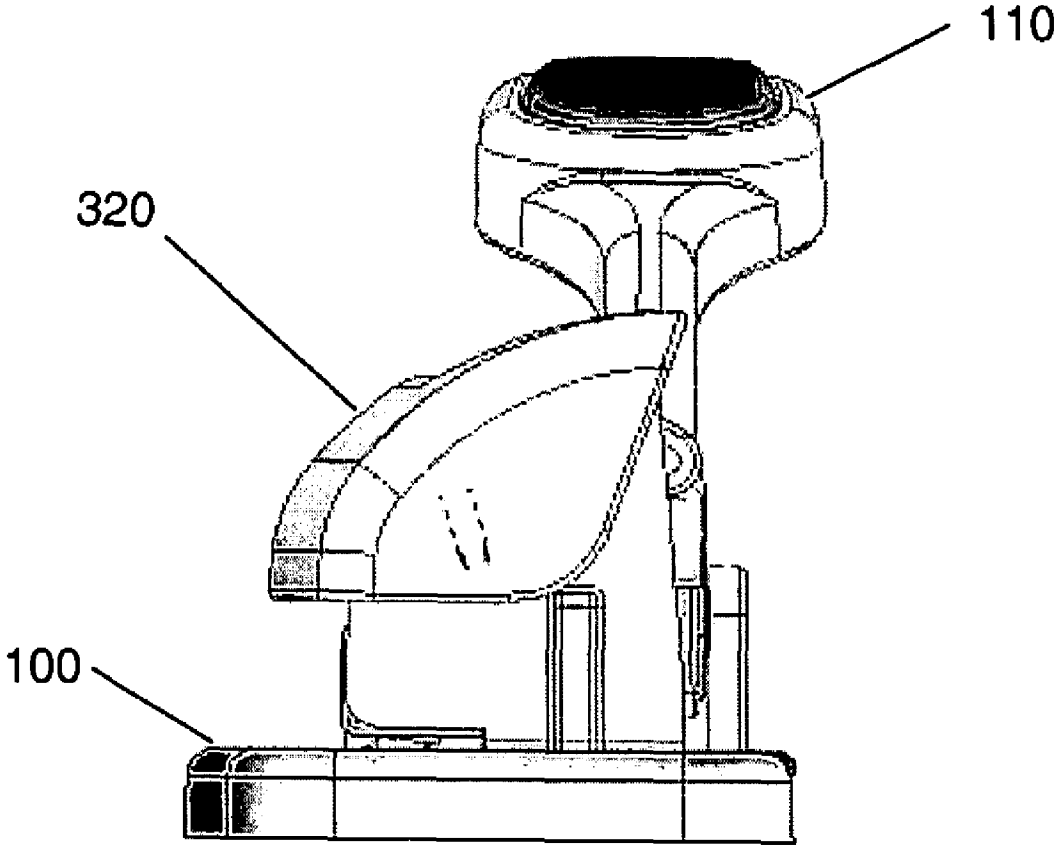
FIG. 7 is a side view of an embodiment of the lever-handled punch with the cover attached.

FIG. 4 is a back view, FIG. 5 is a top view, FIG. 6 is a front view, and FIG. 7 is a side view of an embodiment of the lever-handled punch with the cover attached. FIGS. 4-7 show the position of the cover relative to the other punch components.

The invention has been described in the context of a three-hole paper punch. The invention, however, can be extended to punches having other numbers of holes and for use in punching materials other than paper. The invention should be construed to include any useful equivalents. Such equivalents will be understood to be within the scope of the invention, which is defined by the appended claims and equivalents.

We claim:

1. A punch apparatus for punching holes through a paper stack, comprising:

a punch base with an attached mounting plate;

plural punch pins mounted to the mounting plate for punching through the paper stack;

a lever handle having a handle end, a contact end, and a rotation axis between the handle end and the contact end, the lever handle being rotationally attached at the rotation axis to said mounting plate;

a main shaft rotatably mounted on said punch base; and a lever arm and a plurality of pressure plates attached to the main shaft, the lever arm engaging the contact end of the lever handle and the pressure plates respectively engaging the punch pins;

whereby, when a force in the direction of the punch base is applied to the handle end of the lever handle, the lever handle rotates about the rotation axis, the contact end of the lever handle exerts a force on the lever arm, in the direction opposite to the punch base and at a location spaced from the rotation axis, which rotates the main shaft and the attached pressure plates, and the pressure plates exert a punching force in the direction of the punch base respectively on the punch pins thereby causing the punch pins to punch through the paper stack.

2. The punch apparatus according to claim 1, wherein the punching force is greater than the force applied to the handle end of the lever handle due to a mechanical advantage of the lever handle.

3. The punch apparatus according to claim 1, wherein each of the punch pins is aligned in a punch head bracket adjustably mounted to the mounting plate; each of the punch head brackets has a paper feed slot for positioning the paper stack; each of the punch pins has a top end engaged by the corresponding pressure plate and a punch end for punching through the paper stack positioned in the paper feed slot.

4. The punch apparatus according to claim 3, wherein the punch pins are spring mounted in the punch head brackets such that the punch ends are retracted above the paper feed slot when the punching force is not being applied.

5. The punch apparatus according to claim 3, further comprising a cover mounted on the punch base for covering the mounting plate, the main shaft, the lever arm, the pressure plates, and the plural punch head brackets, wherein the cover does not move during operation of the punch apparatus.

6. The punch apparatus according to claim 1, wherein the contact end of the lever handle is a cylindrically-shaped transverse pin.

7. The punch apparatus according to claim 1, wherein the lever arm has a cylindrically-shaped contact pin for engaging the contact end of the lever handle.

8. The punch apparatus according to claim 1, wherein the handle end has a padded region.

9. The punch apparatus according to claim 1, wherein the punch base has a chip tray for collecting paper hole cutouts punched from the paper stack.

10. The punch apparatus according to claim 1, wherein the punch base has a window for viewing inside the chip tray.

11. The punch apparatus according to claim 1, wherein the main shaft rotates about a first axis, the punch pins move in the direction of a second axis, and the lever handle rotates about a third axis; wherein the first, second and third axes are orthogonal.

12. A paper punch, comprising:

a base having a substantially rectangular shape;

a mounting plate fixedly attached on the base;

a main shaft rotationally attached along a longitudinal axis of the base, the main shaft has a plurality of longitudinally attached pressure plates and a perpendicularly extending lever arm;

a lever handle rotationally attached to the mounting plate; the lever handle comprising a handle portion, a contact portion, and a rotation axis between the handle and contact portions; the rotation axis being perpendicular to the longitudinal axis; the contact portion of the lever handle contacting the lever arm of the main shaft;

a plurality of punch units attached to the mounting plate and contacted, respectively, by the pressure plates of the main shaft for punching holes in a stack of paper sheets;

whereby an applied force exerted on the handle portion of the lever handle is transferred through the rotation axis to the contact portion which forces the lever arm to rotate the main shaft such that the pressure plates transfer a punching force to the respective plurality of punch units to punch holes in the stack of paper sheets.

13. A punch apparatus for punching holes through a paper stack comprising:

a punch base with an attached mounting plate;

at least one punch pin mounted to the mounting plate for punching through the paper stack;

a lever handle having a handle end, a contact end, and a rotation axis between the handle end and the contact end, the lever handle being rotationally attached at the rotation axis to said mounting plate;

a main shaft rotatably mounted on said punch base; and a lever arm and at least one pressure plate attached to the main shaft, the lever arm engaging the contact end of the lever handle and the at least one pressure plate engaging the at least one punch pin;

whereby, when a force in the direction of the punch base is applied to the handle end of the lever handle, the lever handle rotates about the rotation axis, the contact end of the lever handle exerts a force on the lever arm, in the direction opposite to the punch base and at a location spaced from the rotation axis, which rotates the main shaft and the attached at least one pressure plate, and the at least one pressure plate exerts a punching force in the direction of the punch base on the at least one punch pin thereby causing the at least one punch pin to punch through the paper stack.

14. A paper punch comprising:

a base having a substantially rectangular shape;

a mounting plate fixedly attached on the base;

a main shaft rotationally attached along a longitudinal axis of the base, the main shaft has at least one longitudinally attached pressure plate and a perpendicularly extending lever arm;

a lever handle rotationally attached to the mounting plate; the lever handle comprising a handle portion, a contact portion, and a rotation axis between the handle and contact portions; the rotation axis being perpendicular to the longitudinal axis; the contact portion of the lever handle contacting the lever arm of the main shaft;

at least one punch unit attached to the mounting plate and contacted by the at least one pressure plate of the main shaft for punching a hole in a stack of paper sheets;

whereby an applied force exerted on the handle portion of the lever handle is transferred through the rotation axis to the contact portion which forces the lever arm to rotate the main shaft such that the at least one pressure plate transfers a punching force to the at least one punch unit to punch a hole in the stack of paper sheets.

* * * * *